United States Patent [19]

Wüsthof et al.

[11] 4,380,420

[45] Apr. 19, 1983

[54] INTERNAL GEAR MACHINE WITH ROTARY VALVE DISK

[75] Inventors: Peter Wüsthof, Lohr; Johann Schneider, Lohr-Wombach, both of Fed. Rep. of Germany

[73] Assignee: Rexroth GmbH, Lohr, Fed. Rep. of Germany

[21] Appl. No.: 309,395

[22] Filed: Oct. 7, 1981

Related U.S. Application Data

[63] Continuation of Ser. No. 84,114, Oct. 12, 1979, abandoned.

[30] Foreign Application Priority Data

Oct. 14, 1978 [DE] Fed. Rep. of Germany ..... 2844844

[51] Int. Cl.[3] ..... F01C 1/113; F01C 21/12; F03C 2/22; F04C 2/113

[52] U.S. Cl. ..... 418/61 B; 418/186

[58] Field of Search ..... 418/61 B, 186; 60/384, 60/386

[56] References Cited

U.S. PATENT DOCUMENTS

| | | | |
|---|---|---|---|
| 3,453,966 | 7/1969 | Eddy | 418/61 B |
| 3,825,376 | 7/1974 | Petersen et al. | 418/61 B |
| 3,895,888 | 7/1975 | Roberts | 418/61 B |
| 3,899,270 | 8/1975 | Swedberg | 418/61 B |
| 3,905,728 | 9/1975 | Swedberg | 418/61 B |
| 3,944,378 | 3/1976 | McDermott | 418/61 B |
| 4,087,215 | 5/1978 | Miller | 418/61 B |

*Primary Examiner*—John J. Vrablik

*Attorney, Agent, or Firm*—Michael J. Striker

[57] ABSTRACT

The hydraulic internal gear machine includes a positive displacement unit for the working fluid, the unit being formed of a rotary outer gear which is rigidly connected to a rotary control plate provided with control openings arranged between respective teeth of the outer gear. An inner gear surrounds the outer gear and meshes at one point with the latter to define a plurality of increasing fluid displacement chambers. The inner gear is supported in the machine housing for performing a circular wobbling movement about the center axis of the outer gear. A stationary control plate adjoins the rotary control plate and is provided with second control openings cooperating with the first control openings in the rotary plate. An axially movable plunger is spring-biased against the stationary control plate and forms with the housing cover two annular spaces connected respectively to the intake port and to the discharge port of the working fluid. Each annular space communicates with an assigned set of the second control openings in the stationary plate.

11 Claims, 5 Drawing Figures

INTERNAL GEAR MACHINE WITH ROTARY VALVE DISK

This is a continuation, of application Ser. No. 84,114, filed Oct. 12, 1979, now abandoned.

BACKGROUND OF THE INVENTION

This invention relates generally to a rotary internal gear machine of the type having a centered outer gear supported for rotation about a center axis and an inner gear supported for performing a wobbling movement around the center axis in engagement with the outer gear.

Machines of this type are known in principle from the prior art, for example from the German publication 1,703,406, German Pat. No. 1,528,998 and German patent 1,528,997. Such prior-art machines, however, are equipped with the same control systems as conventional rotary disk machines, that means the fluid displacement unit formed of the inner and outer gears is separated from a hydraulic distributor by means of stationary or movable control plates. From a German publication No. 2,240,632 a control plate is known which forms simultaneously a boundary wall for the fluid displacement unit whereby the control openings formed in the control plate are situated in a central range of the latter and another control plate cooperating with the first-mentioned plate is arranged in a central recess of the outer gear. The flow of the working fluid from the control part to respective pockets or chambers in the fluid displacement unit or vice versa takes place via an additional intermediate piece arranged in a central recess of the internal outer gear, the intermediate piece having a plurality of distributing channels cooperating with connecting channels in the rotary outer gear. This arrangement in which the control part is situated in the central range of the outer gear is suitable for relatively small streams of working fluid and thus for small rotary speeds since the control opening in the control part can be formed with small clearance only.

SUMMARY OF THE INVENTION

It is, therefore, a general object of the present invention to overcome the aforementioned disadvantages.

More particularly, it is an object of the invention to provide an improved internal gear machine of the aforedescribed type which has an increased mechanical and hydraulical efficiency at a minimal size.

Another object of this invention is to provide such an improved machine which in order to attain high working speeds has a control part which has increased control openings.

In keeping with these objects and with others which will become apparent hereafter, one feature of the invention resides, in a hydraulic internal gear machine, in a combination which comprises a housing defining an intake port and a discharge port, a fluid displacement unit arranged in the housing and including a rotary shaft, an outer gear coupled to the shaft for rotation about a center axis, an inner gear in engagement with the outer gear and supported for performing a wobbling movement about the center axis, the inner and outer gears defining a plurality of increasing or decreasing pockets or chambers therebetween, a rotary disk coupled to the shaft for joint rotation and adjoining a side of the inner and outer gears to form a boundary wall for the chambers, the rotary disk having a plurality of first control openings communicating with the interstices between the teeth of the outer gear, a stationary control plate adjoining the rotary disk and being formed with a plurality of second control openings cooperating with the first control openings, and a part of the second control openings communicating with the intake port and another part of the second control openings communicating with the discharge port.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
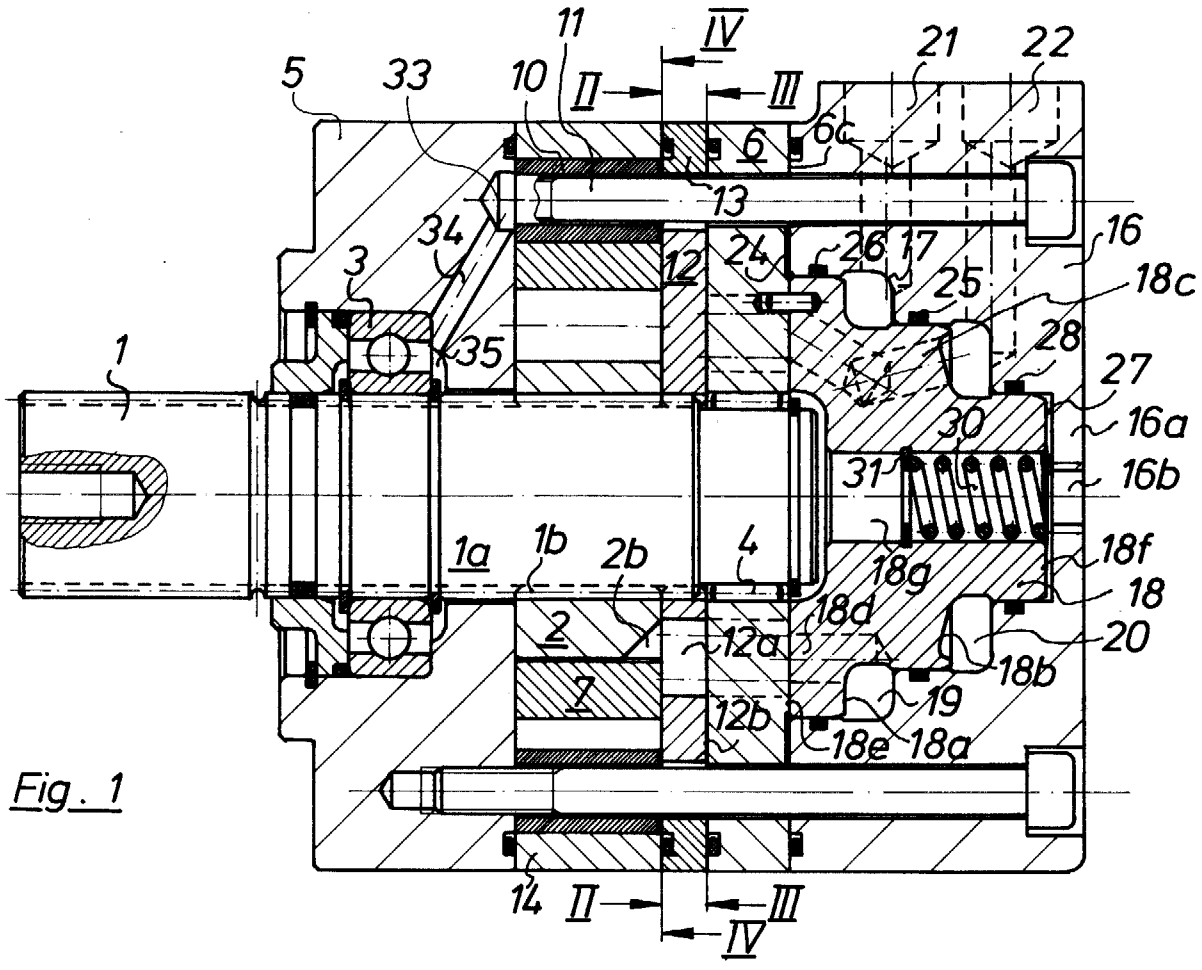
FIG. 1 is an axial section of the internal gear machine of this invention.
Figure 4:
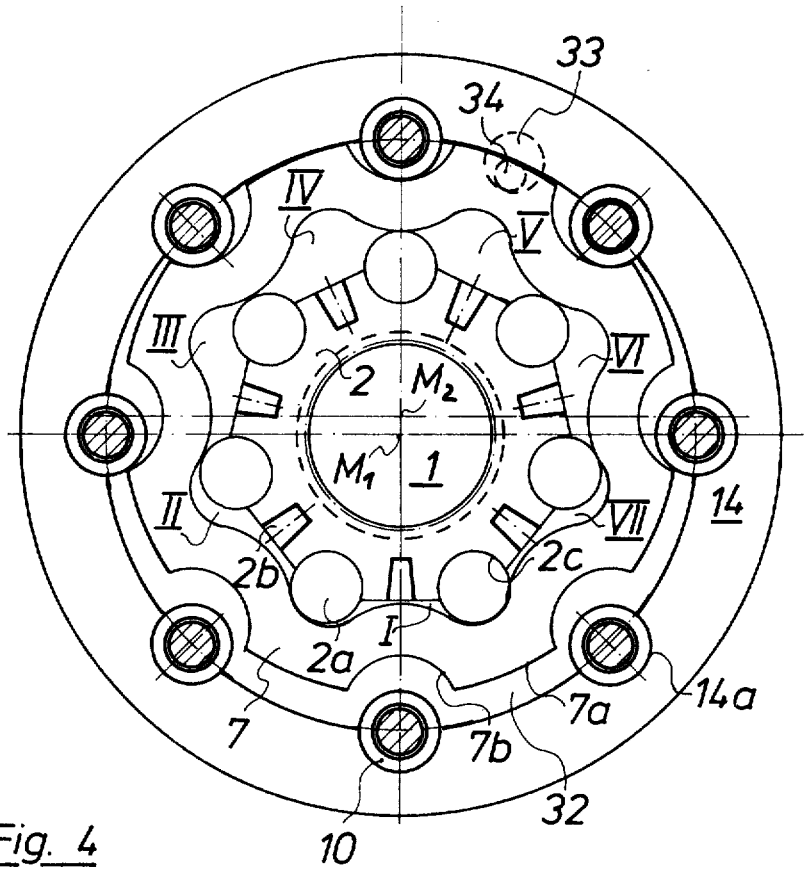
FIG. 4 is a transverse section taken along the line IV—IV of FIG. 1.

Referring firstly to FIG. 1, a rotary shaft 1 is provided in its central range 1*a* with splines 1*b* engaging for joint rotation an outer gear 2. Rotary shaft 1 is supported for rotation in ball bearing 3 and a roller bearing 4, both bearings being mounted respectively in housing parts 5 and 6. An inner gear 7 surrounds the outer gear 2 and forms therewith a fluid displacement unit. The teeth 2*a* of the outer gear 2 are in the form of rollers which continuously engage at one point the inner gear 7 in such a manner as to form a plurality of increasing pockets or chambers I–VII therebetween (FIG. 4). The roller teeth 2*a* are rotatably supported in corresponding semi-cylindrical recesses 2*c* of the outer gear 2. The inner gear 7 has on its outer periphery 7*a* similar semi-cylindrical recesses 7*b* which periodically engage juxtaposed buffer rollers 10 uniformly distributed on the inner wall of a cylindrical housing part 14. The inner diameter of the housing part 14 is slightly larger than the diameter of the inner gear 7 and the diameter of the semi-cylindrical recesses 7*b* is larger than the diameter of buffer rollers 10. As a consequence, inner gear 7 is free to perform a circular wobbling motion about the center axis $M_1$ during which the center axis $M_2$ of the inner gear 7 moves on a circular path around the axis $M_1$ (FIG. 4).

A rotary disk 12 is supported for joint rotation with rotary shift 1 between the housing part 6 and the fluid displacement unit 2 and 7. Axial play of the rotary disk 12 is limited by a spacer ring 13 disposed between the housing part 6 and the cylindrical housing part 14. The housing part 14 which encloses the fluid displacement unit is provided on its inner wall with semi-cylindrical recesses 14*a* in which the aforementioned buffer rollers 10 are seated. In this example, rotary disk 12 engages the same splines 1*b* on the rotary shaft as does the outer gear 2 and the radius of the disk 12 is such as to cover the displacement chamber in any position of the inner gear 7 and consequently forms a lateral boundary wall for the fluid displacement unit.

Figure 2:
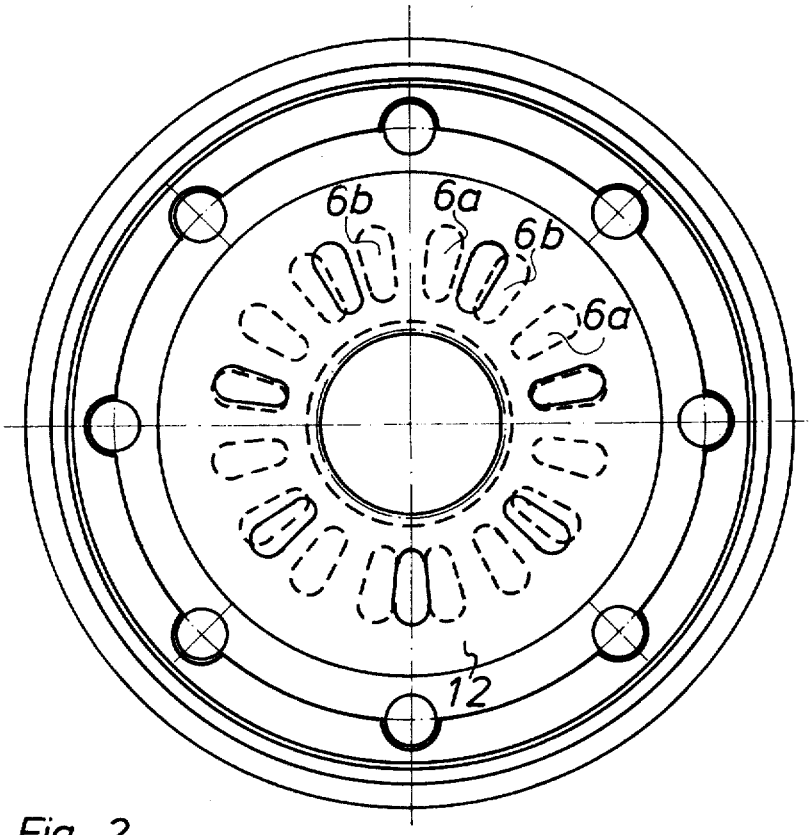
FIG. 2 is a transverse section taken along the line II—II of FIG. 1.
Figure 3:
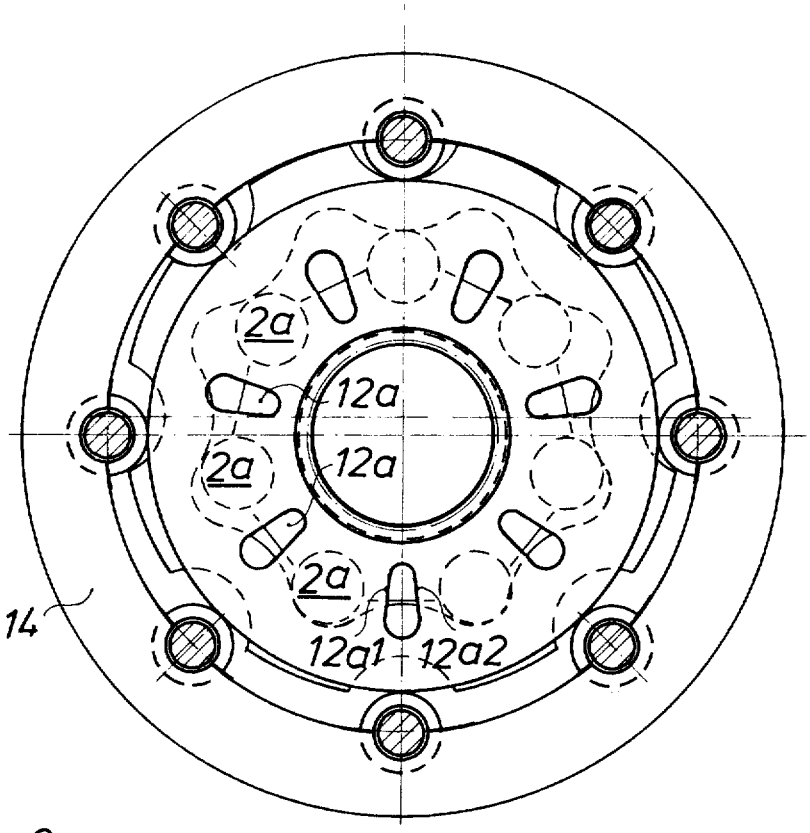
FIG. 3 is a transverse section taken along the line III—III of FIG. 1.

As seen from FIGS. 2 and 3, plate 12 is formed with a plurality of first flow control openings 12*a* which at the face 12*b* of the plate remote from the displacement chamber is formed with straight control edges $12a_1$ and $12a_2$. A stationary plate 6 forming a part of the machine housing is provided with a plurality of second control openings 6*a* and 6*b* arranged for cooperation with the first control openings 12*a* in the control plate 12. According to the direction of rotation of the shaft 1, a set 6*a* of the second control openings communicates with a source of the working liquid and another set 6*b* of the second control openings communicates with a reservoir, or vice versa. Approximately in the middle of the radial extension of the first control openings 12*a* is the root circle of the rotary outer gear 2 which in the range of the openings 12*a* has guiding grooves 2*b* for the working liquid. As seen from FIGS. 1 and 4, the grooves 2*b* establish continuous communication between interstices of teeth 2*a* of the outer gear 2 and the first control openings 12*a*, irrespective of mutual position of inner gear 7 and outer gear 2. A housing cover 16 which adjoins the stationary control plate 6 has a stepped central recess 17 which accommodates a correspondingly stepped axial plunger 18. The annular flanges 18*a* and 18*b* of the plunger 18 bound the steps of the bore 17 to annular spaces 19 and 20 communicating respectively with intake channel 21 connectable to a source of pressure liquid, and with a discharge channel 22 connectable to a reservoir. Channels 18*c* and 18*d* in the plunger 18 lead, respectively, from flanges 18*a* and 18*b* and connect the annular spaces 19 and 20 to respective sets 6*a* and 6*b* of the second control openings in the stationary housing plate 6. In dependence on the direction of rotation of shaft 1, the annular spaces 19 and 20 communicate with the source of pressure fluid and accordingly one of the annular surfaces 18*a* and 18*b* is acted upon by the pressure fluid. This pressure is transmitted to the bottom end face 18*e* of plunger 18 and therefrom to the outer face 6*c* of the stationary housing plate 6 which is hermetically sealed from the pressure fluid in the annular spaces 19 and 20. As a result any deflection of the housing plate 6 toward the housing cover 16 which might result due to the pressure in the chambers of the fluid displacement unit is effectively prevented. The size of the ring surfaces 18*a* and 18*b* corresponds approximately to the annular inner surface portion of the rotary plate 12 which bounds the chambers of the liquid displacement units 2 and 7. The annular spaces 19 and 20 are sealed from one another and from the stationary housing plate 6 by sealing rings 25 and 26 and from a gap 27 between the top surface 18*f* of plunger 18 and the bottom surface 16*a* of the housing cover 16 by sealing ring 28. Plunger 18 is provided with a central passage 18*g* through which any leaking working fluid which may occur during the operation of the machine flows toward a leakage fluid outlet 16*b* in the bottom 16*a* of the housing cover. The central passage 18*g* accommodates at the same time a pressure spring 30 resting at one end thereof on the bottom 16*a* of the housing cover and at its other end on a snap ring 31 to bias plunger 18 against the stationary housing plate 6.

Leaking liquid penetrating into the interspace 32 between the inner gear 7 and the inner wall of the housing part 14 is conducted into a collecting chamber 33 in the form of a blind bore in the housing 14 and is discharged via a connection passage 34 in the housing part 5 into an annular bearing space 35 communicating with the ball bearing 3 and therefrom is fed via splines 1*b* on shaft 1 through roller bearing 4 into the central passage 18*g* of the plunger 18.

Figure 5:
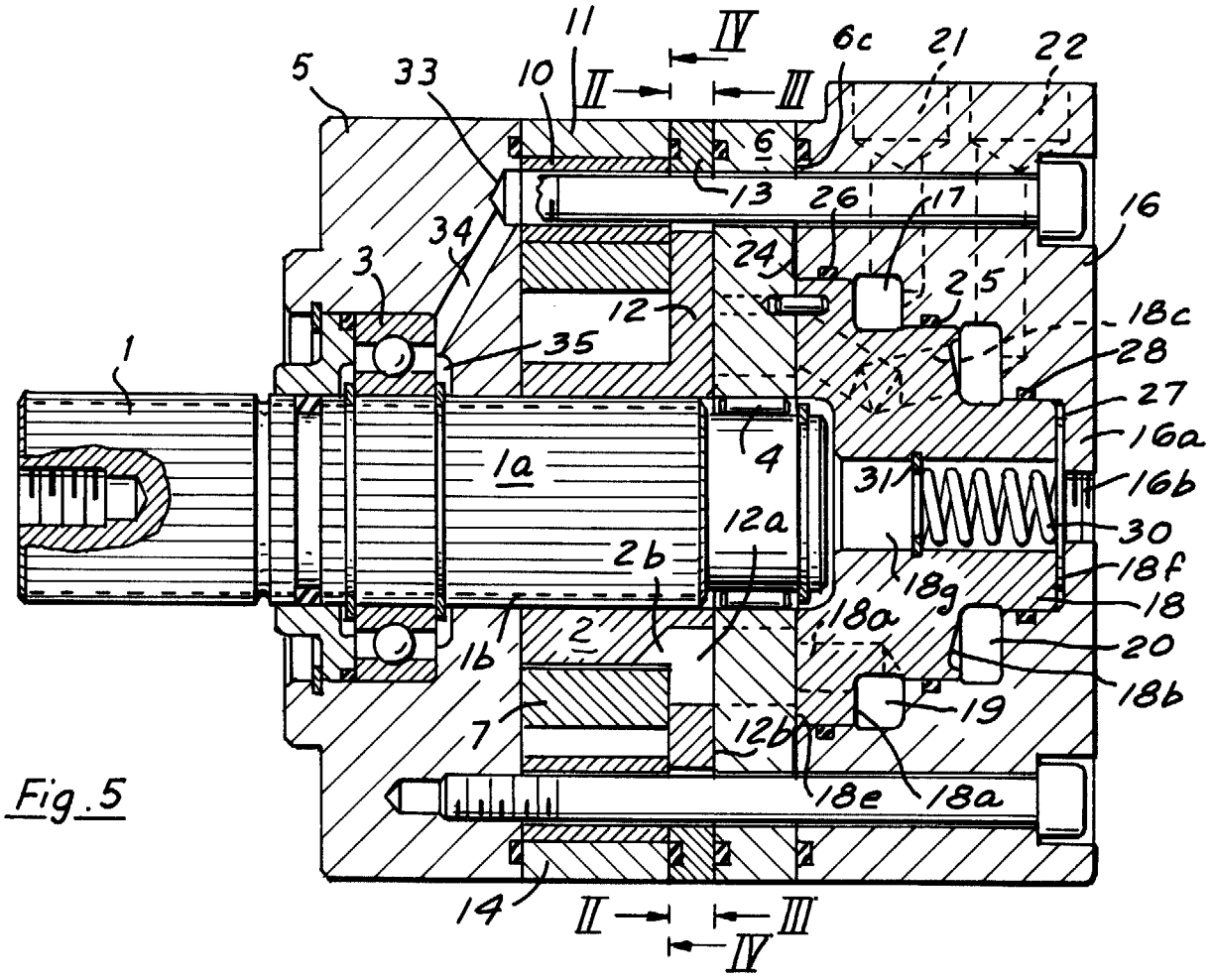
FIG. 5 is a modification of FIG. 1.

Rotary plate 12 can be connected to the rotary outer gear 2 by screws or by welding, for example to form therewith a single structural unit. It is of course also possible to manufacture the outer gear 2 and the rotary plates 10 as an integral component part, as illustrated in FIG. 5. Due to the fact that the rotary plate 12 which is provided with the control openings 6 is rigidly connected to the rotary outer gear 2, minimum leakage and frictional losses take place and as a result the total efficiency of the internal gear machine is substantially increased.

It will be understood that each of the elements described above, or two or more together, may also find a useful application in other types of constructions differing from the types described above.

While the invention has been illustrated and described as embodied in a hydraulic internal gear machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An internal gear machine, comprising a housing defining an intake port and a discharge port; a fluid displacement unit arranged in said housing and including a rotary shaft defining a center axis; an outer gear coupled for joint rotation to said shaft; an inner gear in sliding engagement with said outer gear and supported for performing a wobbling movement in said housing about said center axis, said inner and outer gears defining a plurality of variable chambers therebetween; and flow control means including a rotary disk coupled for joint rotation to said shaft and forming a lateral boundary wall for said chambers, said rotary disk having a plurality of first control openings each of said openings continuously communicating with interstices between the teeth of said outer gear in any position of the outer gear relative to the inner gear, and a stationary control plate adjoining said rotary disk and being formed with a plurality of second control openings cooperating with said first control openings, a part of said second control openings communicating with said intake port and another part of said second control openings communicating with said discharge port.

2. The machine as defined in claim 1, wherein said shaft is provided with splines engaging said outer gear and said rotary plate.

3. The machine as defined in claim 1, wherein said outer gear and said rotary plate are rigidly connected to one another to form a single structural unit.

4. The machine as defined in claim 1, wherein said housing includes a tubular portion enclosing said inner gear and a sealing spacer ring enclosing said rotary plate and delimiting the axial play of the latter between said tubular housing part and said stationary control plate.

5. The machine as defined in claim 4, wherein said tubular housing part enclosing said fluid displacement unit is provided with a leakage fluid collecting chamber communicating with the surface of said shaft.

6. The machine as defined in claim 1, wherein said housing further includes a housing cover connected to the outer face of said stationary control plate, said housing cover having a stepped central bore, a stepped plunger accommodated in said stepped central bore and defining therewith two annular spaces connected respectively to said intake port and to said discharge port and communicating with said second control openings in said stationary plate.

7. The machine as defined in claim 6, wherein the clearance of each of said annular spaces in said housing cover corresponds substantially to the surface portion of said rotary plate which bounds said chambers in said fluid displacement unit.

8. The machine as defined in claim 6, wherein said plunger is spring-biased against said stationary control plate.

9. An internal gear machine, comprising a housing defining an intake port and a discharge port; a fluid displacement unit arranged in said housing and including a rotary shaft defining a central axis; an outer gear coupled for joint rotation to said shaft; an inner gear in sliding engagement with said outer gear and supported for performing a wobbling movement in said housing about said center axis, said inner and outer gears defining a plurality of variable chambers therebetween; flow control means including a rotary disk coupled for joint rotation to said shaft and forming a lateral boundary wall for said chambers, said rotary disk having a plurality of first control openings communicating with the interstices between the teeth of said outer gear, and a stationary control plate adjoining said rotary disk and being formed with a plurality of second control openings cooperating with said first control openings, a part of said second control openings communicating with said intake port and another part of said second control openings communicating with said discharge port, and wherein the root circle of said outer gear extends approximately to the middle of the radial extension of said first control openings.

10. The machine as defined in claim 9, wherein the parts of said outer gear situated in the range of said first control openings in said rotary plate are provided with recesses for guiding the fluid into and from said first control openings.

11. An internal gear machine, comprising a housing defining an intake port and a discharge port; a fluid displacement unit arranged in said housing and including a rotary shaft defining a center axis; an outer gear coupled for joint rotation to said shaft; an inner gear in sliding engagement with said outer gear and supported for performing a wobbling movement in said housing about said center axis, said inner and outer gears defining a plurality of variable chambers therebetween; a rotary disk coupled for joint rotation to said shaft and forming a lateral boundary wall for said chambers; said rotary disk having a plurality of first control openings communicating with the interstices between the teeth of said outer gear; a stationary control plate adjoining said rotary disk and being formed with a plurality of second control openings cooperating with said first control openings, a part of said second control openings communicating with said intake port and another part of said second control openings communicating with said discharge port; said housing further including a housing cover connected to the outer face of said stationary control plate, said housing cover having a stepped central bore, a stepped plunger accommodated in said stepped central bore and defining therewith two annular spaces connected respectively to said intake port and to said discharge port and communicating with said second control openings in said stationary plate; said plunger being spring-biased against said stationary control plate; and said plunger and said housing cover being provided with aligned central passages for discharging leakage fluid from said housing.

* * * * *